US012508499B1

(12) United States Patent
Salem

(10) Patent No.: US 12,508,499 B1
(45) Date of Patent: Dec. 30, 2025

(54) MULTI-COMPONENT STRUCTURE

(71) Applicant: Inai Holding LLC, Menifee, CA (US)

(72) Inventor: Jamal M. Salem, Menifee, CA (US)

(73) Assignee: Inai Holding LLC, Menifee, CA (US)

( * ) Notice: Subject to any disclaimer, the term of this patent is extended or adjusted under 35 U.S.C. 154(b) by 0 days.

(21) Appl. No.: 19/072,488

(22) Filed: Mar. 6, 2025

(51) Int. Cl.
*A63F 9/12* (2006.01)

(52) U.S. Cl.
CPC ..... *A63F 9/12* (2013.01); *A63F 2009/1212* (2013.01); *A63F 2009/124* (2013.01)

(58) Field of Classification Search
CPC ..... A63F 9/12; A63F 2009/1212; A63F 2009/124
USPC ..... D21/479
See application file for complete search history.

(56) References Cited

U.S. PATENT DOCUMENTS

| | | | | | |
|---|---|---|---|---|---|
| 245,533 | A * | 8/1881 | McChesney | A63F 9/12 | 273/160 |
| 1,546,024 | A * | 7/1925 | Reichenbach | A63F 9/12 | 273/160 |
| 3,523,384 | A | 8/1970 | Adelsohn | | |
| 3,564,735 | A | 2/1971 | Fisher | | |
| 3,650,379 | A | 3/1972 | La Montagne | | |
| 3,679,212 | A | 7/1972 | Smith | | |
| 3,779,558 | A * | 12/1973 | Moreau | A63F 9/12 | 273/157 R |
| 4,886,273 | A * | 12/1989 | Unger | A63F 9/34 | 273/455 |
| 5,118,111 | A * | 6/1992 | Suitor | A63F 9/12 | 428/11 |
| 5,127,652 | A * | 7/1992 | Unger | A63F 9/0278 | 446/419 |
| D393,020 | S * | 3/1998 | Arcos | D21/713 | |
| 6,095,521 | A | 8/2000 | Patel | | |
| D432,604 | S * | 10/2000 | Scheiner | D21/713 | |
| 6,601,849 | B1 | 8/2003 | Konkle et al. | | |
| D480,648 | S * | 10/2003 | Hawkes | D9/519 | |
| 10,532,276 | B2 * | 1/2020 | Andrews | A63F 9/12 | |
| 2010/0194043 | A1 * | 8/2010 | Pavlovic | A63F 9/0873 | 273/157 R |
| 2017/0266578 | A1 * | 9/2017 | Apyshkov | A63H 33/046 | |

FOREIGN PATENT DOCUMENTS

| | | | | |
|---|---|---|---|---|
| GB | 1288320 A * | 9/1972 | A63F 9/12 | |
| GB | 2207360 A * | 2/1989 | A63F 9/1288 | |
| JP | 07222878 A * | 8/1995 | | |
| KR | 20150059240 A * | 6/2015 | | |

* cited by examiner

*Primary Examiner* — Steven B Wong
(74) *Attorney, Agent, or Firm* — Weisberg I.P. Law, P.A.

(57) ABSTRACT

A multi-component structure comprising complementary segments and the multi-component structure comprises a first complementary segment having a first convex portion and a first concave portion. The first convex portion is contiguous with the first concave portion. The multi-component structure further comprises a second complementary segment and a second convex portion, the second concave portion being contiguous with the second convex portion, the second concave portion sized to be received within the first convex portion and the second convex portion that is sized to be received within the first concave portion. When the first complementary segment and the second complementary segment are releasably secured to one another, the two segments form a first hemisphere.

14 Claims, 10 Drawing Sheets

MULTI-COMPONENT STRUCTURE

TECHNICAL FIELD

The present disclosure relates to movable structures and more particularly a three-dimensional movable structure having a plurality of complementary parts and a method of using the three-dimensional movable structure.

BACKGROUND

Three-dimensional apparatuses that one can take apart and put back together have been available for centuries and have numerous benefits. These three-dimensional apparatuses may range from small to large in size and may have logos and representations of personal words, characters, symbols or other inspirational messages on them (like a tattoo). Three-dimensional apparatuses can help with challenging one's cognitive abilities including problem solving, critical thinking, and logical reasoning. Engaging with three-dimensional apparatuses, which may include puzzles, can help the brain with improving an individual's memory and helping with acquiring and retaining a variety of different types of information. Also, three-dimensional apparatuses can help decease stress and anxiety. Engaging with three-dimensional apparatuses in a variety of different manners and settings can help escape the chaos of the day even if for a finite period of time and provide a mindful activity that leads to a sense of calm and the feeling of relaxation.

Further, in the fast paced world, engaging with three-dimensional apparatuses can help with improving an individual's patience and persistence. Although three-dimensional apparatuses can sometimes cause frustration as the individual tries to determine how the three-dimensional apparatus may work and/or be put together, overcoming an obstacle after encountering a period of frustration can help with teaching determination and using a methodical approach to solve personal and professional problems. Further, interaction with three-dimensional apparatuses can help increase general visual awareness which can assist in the recognition of patterns which surround us on a daily basis. This increased awareness can help develop an individual's creativity, help develop stronger pattern recognition, and help in boosting the user's confidence and self-esteem.

Three-dimensional apparatuses can help to maintain and sometimes increase mental dexterity depending upon how an individual interacts with the apparatus. For example, working on puzzles can reinforce brain cell connections and mental speed which in turn can improve short-term memory. Also, when solving a puzzle, dopamine is released in the body which creates a positive mood and can help aid with memory and concentration. At night, puzzles can be used to unwind and relax without engaging with screens.

When individuals are happier, more satisfied, and less stressed, it can be easier to focus. When concentration improves, an individual's productivity can increase dramatically. Engaging with three-dimensional apparatuses can help reset the brain and help with disconnecting so that an individual is ready and able to reengage and connect with the world around them.

SUMMARY

Some embodiments advantageously provide a method and multi-component structure having a plurality of complementary segments. There may be at least two or more complementary segments that can be used in the movable structure. Further, various securing mechanisms may be used to secure each complementary segment to another complementary segment that forms part of the multi-component structure.

According to one aspect a multi-component structure may comprise complementary segments. The multi-component structure may comprise a first complementary segment having a first convex portion and a first concave portion. The first convex portion of the first complementary segment may be contiguous with the first concave portion. The multi-component structure may further comprise a second complementary segment having a second concave portion and a second convex portion. The second concave portion may be sized to be received within the first convex portion and the second convex portion may be sized to be received within the first concave portion. The first complementary segment and the second complementary segment may be releasably securable to one another to form a first hemisphere.

In some embodiments, the multi-component structure further comprises the first complementary segment having a first bottom surface. The first bottom surface has a first circular portion joined to a first elongate portion. The multi-component structure further comprises the second complementary segment having a second bottom surface. The second bottom surface has a second circular portion joined to a second elongate portion.

In some embodiments, the multi-component structure further comprises a first indicia on the first bottom surface and a second indicia on the second bottom surface. The first and the second indicia may be complementary to one another.

In some embodiments, the multi-component structure further comprises at least one securing mechanism that releasably secures the first complementary segment to the second complementary segment.

In some embodiments, the at least one securing mechanism is at least one magnet.

In some embodiments, the at least one magnet is a first magnet and a second magnet. The first magnet may be disposed within the first complementary segment and the second magnet may be disposed within the second complementary segment.

In some embodiments, the multi-component structure further comprises a third complementary segment having a third convex portion and a third concave portion, the third convex portion being contiguous with the third concave portion. The multi-component structure may further comprise a fourth complementary segment having a fourth convex portion and a fourth concave portion. The fourth convex portion may be contiguous with the fourth concave portion, the fourth concave portion sized to be received within the third convex portion and a fourth convex portion that is sized to be received within the third concave portion. The third complementary segment and the fourth complementary segment may be releasably securable to form a second hemisphere. The first hemisphere may be releasably securable to the second hemisphere to form a sphere.

In some embodiments, the multi-component structure has a third bottom surface where the third bottom surface has a third circular portion that is joined to a third elongate portion. The fourth complementary segment has a fourth bottom surface, the fourth bottom surface having a fourth circular portion joined to a second elongate portion.

In some embodiments, the multi-component structure further comprises the first complementary segment having a first inner surface with a first contour. The first inner surface may have the first convex portion and the first concave portion where the first convex portion and the first concave portion are proximate the first contour and follow the first contour of the first inner surface, and a first outer surface that forms a first quarter circle. The multi-component structure may further comprise the second complementary segment having a second inner surface with a second contour. The second inner surface may have the second convex portion and the second concave portion where the second convex portion and the second concave portion are proximate the second contour and follow the second contour of the second inner surface, and a second outer surface that forms a second quarter circle.

In some embodiments, the multi-component structure further comprises the third complementary segment having a third inner surface with a third contour. The third inner surface may have the third convex portion and the third concave portion where the third convex portion and the third concave portion are proximate the third contour and follow the third contour of the third inner surface, and a third outer surface that forms a third quarter circle. The multi-component structure may further comprise the fourth complementary segment having a fourth inner surface with a fourth contour. The fourth inner surface may have the fourth convex portion and the fourth concave portion where the fourth convex portion and the fourth concave portion are proximate the fourth contour and follow the fourth contour of the fourth inner surface, and a fourth outer surface that forms a fourth quarter circle.

In some embodiments, the multi-component structure further comprises at least one securing mechanism that releasably secures the first complementary segment to the second complementary segment and releasably secures the third complementary segment to the fourth complementary segment. The first hemisphere can be releasably engaged with the second hemisphere to create a sphere.

In some embodiments, the at least one securing mechanism is at least one magnet.

According to one aspect, a multi-component structure may comprise complementary segments, the multi-component structure comprising a first complementary segment having a first convex portion and a first concave portion, the first convex portion being contiguous with the first concave portion. The multi-component structure further comprises a second complementary segment having a second concave portion and a second convex portion, the second concave portion being contiguous with the second convex portion. The second concave portion sized to be received within the first convex portion and a second convex portion that is sized to be received within the first concave portion. The multi-component structure further comprises a third complementary segment having a third convex portion and a third concave portion, the third convex portion being contiguous with the third concave portion. The multi-component structure further comprises a fourth complementary segment having a fourth convex portion and a fourth convex portion, the fourth convex portion being contiguous with the fourth convex portion. The fourth concave portion sized to be received within the third concave portion and a fourth concave portion that is sized to be received within the third convex portion. The first complementary segment being releasably securable to the second complementary segment to form a first hemisphere. The third complementary segment being releasably securable to the fourth complementary segment to form a second hemisphere, and the first hemisphere and the second hemisphere being releasably securable to form a sphere.

In some embodiments, the first complementary segment has a first inner surface and a first contour. The first inner surface has the first convex portion and the first concave portion where the first convex portion and the first concave portion are proximate the first contour and follow the first contour of the first inner surface, and a first outer surface that forms a first quarter circle. The multi-component structure further comprises the second complementary segment having a second inner surface and a second contour, the second inner surface having the second convex portion and the second concave portion where the second convex portion and the second concave portion are proximate the second contour and follow the second contour of the second inner surface, and a second outer surface that forms a second quarter circle. The multi-component structure further comprises the third complementary segment having a third inner surface with a third contour, the third inner surface having the third convex portion and the third concave portion where the third convex portion and the third concave portion are proximate the third contour and follow the third contour of the third inner surface, and a third outer surface that forms a third quarter circle. The multi-component structure further comprises the fourth complementary segment having a fourth inner surface with a fourth contour, the fourth inner surface having the fourth convex portion and the fourth concave portion where the fourth convex portion and the fourth concave portion are proximate the fourth contour and follow the fourth contour of the fourth inner surface, and a fourth outer surface that forms a fourth quarter circle.

In some embodiments, the first complementary segment has a first bottom surface, the first bottom surface having a first circular portion joined to a first elongate portion. The second complementary segment has a second bottom surface, the second bottom surface having a second circular portion joined to a second elongate portion. The third complementary segment has a third bottom surface, the third bottom surface having a third circular portion joined to a third elongate portion. The fourth complementary segment has a fourth bottom surface, the fourth bottom surface having a fourth circular portion joined to a fourth elongate portion.

In some embodiments, the multi-component structure further comprises a first securing mechanism disposed within the first circular portion of the first bottom surface and a second securing mechanism disposed within the second circular portion of the second bottom surface. The first securing mechanism may be releasably engageable with the second securing mechanism when the first complementary segment is secured with the second complementary segment. A third securing mechanism may be disposed within the third circular portion of the third bottom surface and a fourth securing mechanism disposed within the fourth circular portion of the fourth bottom surface. The third securing mechanism may be releasably engageable with the fourth securing mechanism and when the third complementary segment is secured with the fourth complementary segment, the first hemisphere and the second hemisphere may be releasably securable to form a sphere.

In some embodiments, the first securing mechanism is a first magnet, the first magnet being disposed within the first circular portion so that the first magnet is flush with the first bottom surface of the first circular portion. The second securing mechanism may be a second magnet, the second magnet being disposed within the second circular portion so that the second magnet is flush with the second bottom surface of the second circular portion. The third securing mechanism may be a third magnet, the third magnet being disposed within the third circular portion so that the third magnet is flush with the third bottom surface of the third circular portion. The fourth securing mechanism may be a fourth magnet, the fourth magnet being disposed within the fourth circular portion so that the fourth magnet is flush with the fourth bottom surface of the fourth circular portion.

In some embodiments, the first securing mechanism is a first magnet, the first magnet being disposed within the first circular portion so that the first magnet protrudes from the first bottom surface of the first circular portion. The second securing mechanism may be a second magnet, the second magnet being disposed within the second circular portion so that the second magnet protrudes from the second bottom surface of the second circular portion. The third securing mechanism may be a third magnet, the third magnet being disposed within the third circular portion so that the third magnet protrudes from the third bottom surface of the third circular portion. The fourth securing mechanism may be a fourth magnet, the fourth magnet being disposed within the fourth circular portion so that the fourth magnet protrudes from the fourth bottom surface of the fourth circular portion.

In some embodiments, the first securing mechanism is a first magnet, the first magnet being disposed within the first circular portion so that the first magnet is recessed within the first bottom surface of the first circular portion. The second securing mechanism may be a second magnet, the second magnet being disposed within the second circular portion so that the second magnet is recessed within the second bottom surface of the second circular portion. The third securing mechanism may be a third magnet, the third magnet being disposed within the third circular portion so that the third magnet is recessed within the third bottom surface of the third circular portion. The fourth securing mechanism may be a fourth magnet, the fourth magnet being disposed within the fourth circular portion so that the fourth magnet is recessed within the fourth bottom surface of the fourth circular portion.

According to one aspect, a method for forming a sphere where the method comprises engaging a first complementary segment having a first convex portion and a first concave portion. The first convex portion may be contiguous with the first concave portion with a second complementary segment having a second concave portion and a second convex portion, the second concave portion being contiguous with the second convex portion, the second concave portion sized to be received within the first convex portion and a second convex portion that is sized to be received within the first concave portion. When the first complementary segment and the second complementary segment are releasably secured to one another the two segments form a first hemisphere. The method may further comprise engaging a third complementary segment having a third convex portion and a third concave portion, and the third convex portion may be contiguous with the third concave portion with a fourth complementary segment having a fourth concave portion and a fourth convex portion, the fourth concave portion being contiguous with the fourth convex portion, the fourth concave portion sized to be received within the third convex portion and a fourth convex portion that is sized to be received within the third concave portion. When the third complementary segment and the fourth complementary segment are releasably secured to one another the two segments form a second hemisphere. The method may further comprise engaging the first hemisphere with the second hemisphere to create a sphere.

BRIEF DESCRIPTION OF THE DRAWINGS

A more complete understanding of embodiments described herein, and the attendant advantages and features thereof, will be more readily understood by reference to the following detailed description when considered in conjunction with the accompanying drawings wherein.

DETAILED DESCRIPTION

Figure 1A:
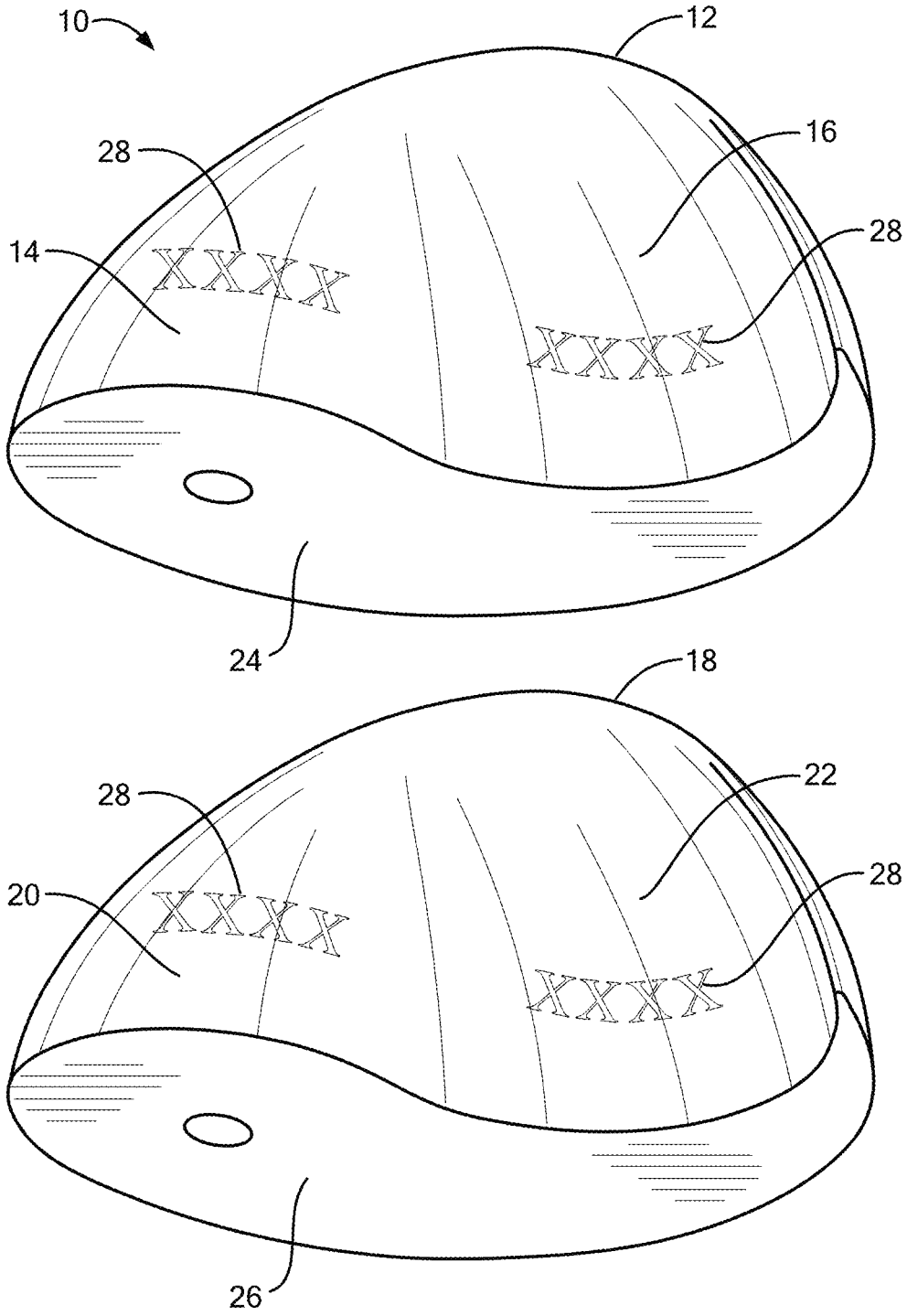
FIG. 1*a* is a perspective first view of an exemplary embodiment of the multi-component structure of the present disclosure.

Before describing in detail exemplary embodiments, it is noted that the embodiments reside primarily in combinations of multi-component structure components. Accordingly, the multi-component structure and method components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

As used herein, relational terms, such as "first" and "second," "top" and "bottom," and the like, may be used solely to distinguish one entity or element from another entity or element without necessarily requiring or implying any physical or logical relationship or order between such entities or elements. The terminology used herein is for the purpose of describing particular embodiments only and is not intended to be limiting of the concepts described herein. As used herein, the singular forms "a", "an" and "the" are intended to include the plural forms as well, unless the context clearly indicates otherwise. It will be further understood that the terms "comprises," "comprising," "includes" and/or "including" when used herein, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

Referring now to the drawing figures, in which like elements are referred to by like reference numerals, there is shown in FIG. 1*a* a first view of the multi-component structure 10 of the present disclosure. Multi-component structure 10 includes a first complementary segment 12 of the multi-component structure 10 generally designated as "the a multi-component structure 10." It will be understood that the exemplary embodiment show in FIG. 1*a* may have two complementary segments, however, in other embodiments of the present disclosure, there may be two or more complementary segments.

According to one embodiment, the multi-component structure 10 may include the first complementary segment 12 and the first complementary segment 12 may have a first convex portion 14 and a first concave portion 16. The first convex portion 14 may be curved or rounded outwardly, for example, like the exterior of a sphere or circle. The first concave portion 16 may be curved inwardly, for example, like a portion of the hollowed out inside of a bowl. As shown in the non-limiting example in FIG. 1*a*, the first convex portion 14 may be contiguous with the first concave portion 16 on the first complementary segment 12 such that the first convex portion 14 is in actual contact with the first concave portion 16 and in direct contact with one another. The first convex portion 14 is formed in part of the first complementary segment 12 and the first convex portion 14 is in direct contact with the first concave portion 16 such that the first convex portion 14 and the first concave portion 16 appear as a continuous piece and the continuous pieces are not separated. The first convex portion 14 and the first concave portion 16 may be found proximate a first inner surface 24 of the first complementary segment 12. The contiguous first convex portion 14 and first concave portion 16 may follow the contour of the first inner surface 24, a first contour, to create a unique shape and design. It will be understood that the first complementary segment 12 may have a plurality of different surfaces which are the same and/or different from one another.

The multi-component structure 10 may further include a second complementary segment 18 and the second complementary segment 18 may include a second convex portion 20 and a second concave portion 22. Similar to the first convex portion 14, the second convex portion 20 may be curved or rounded outwardly, for example, like the exterior of a sphere or circle. Also, similar to the first concave portion 16, the second concave portion 22 may be curved inwardly, for example, like the hollowed out inside of a bowl. As shown in the non-limiting example in FIG. 1*a*, the second convex portion 20 may be contiguous with the second concave portion 22 on the second complementary segment 18 such that the second convex portion 20 is in actual contact with the second concave portion 22 and is in direct contact with one another.

Figure 1B:
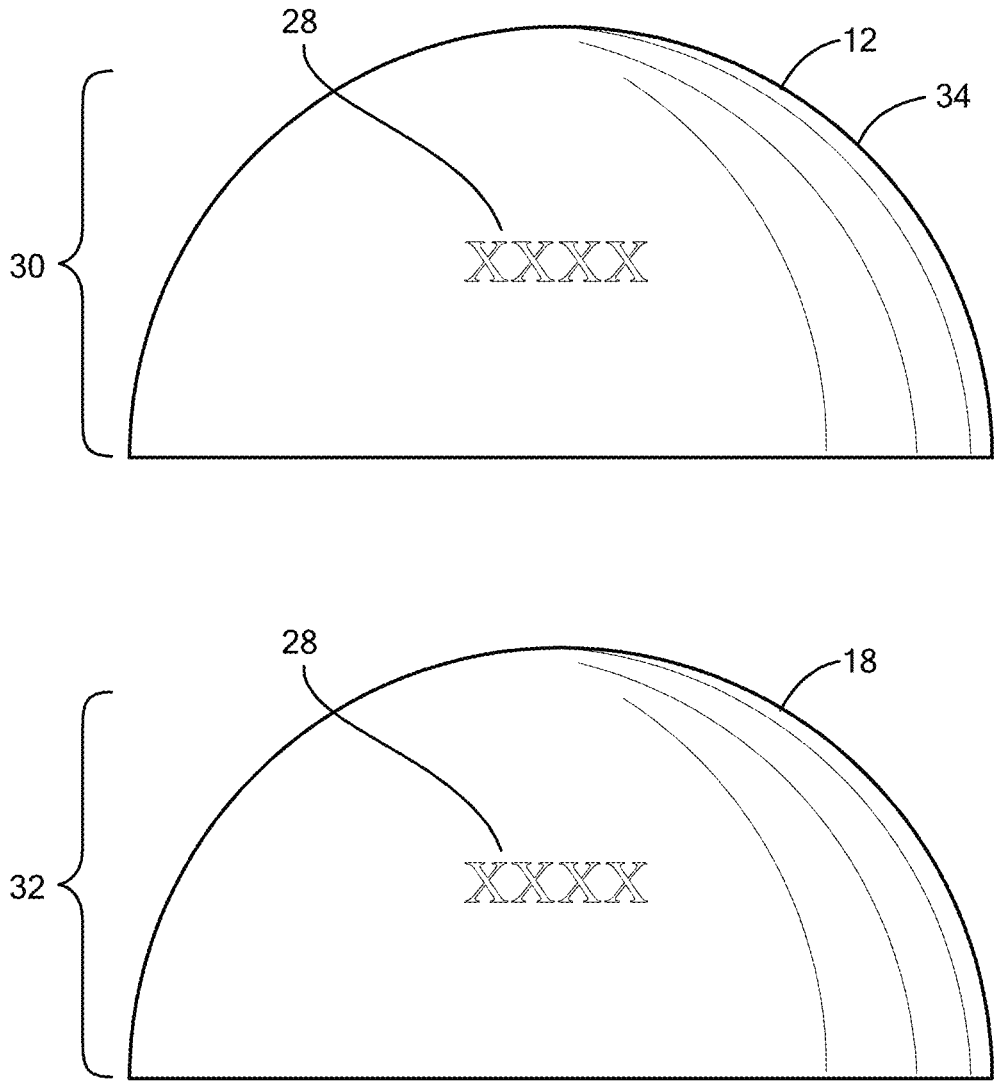
FIG. 1*b* is a side view of the multi-component structure of the present disclosure.
Figure 1C:
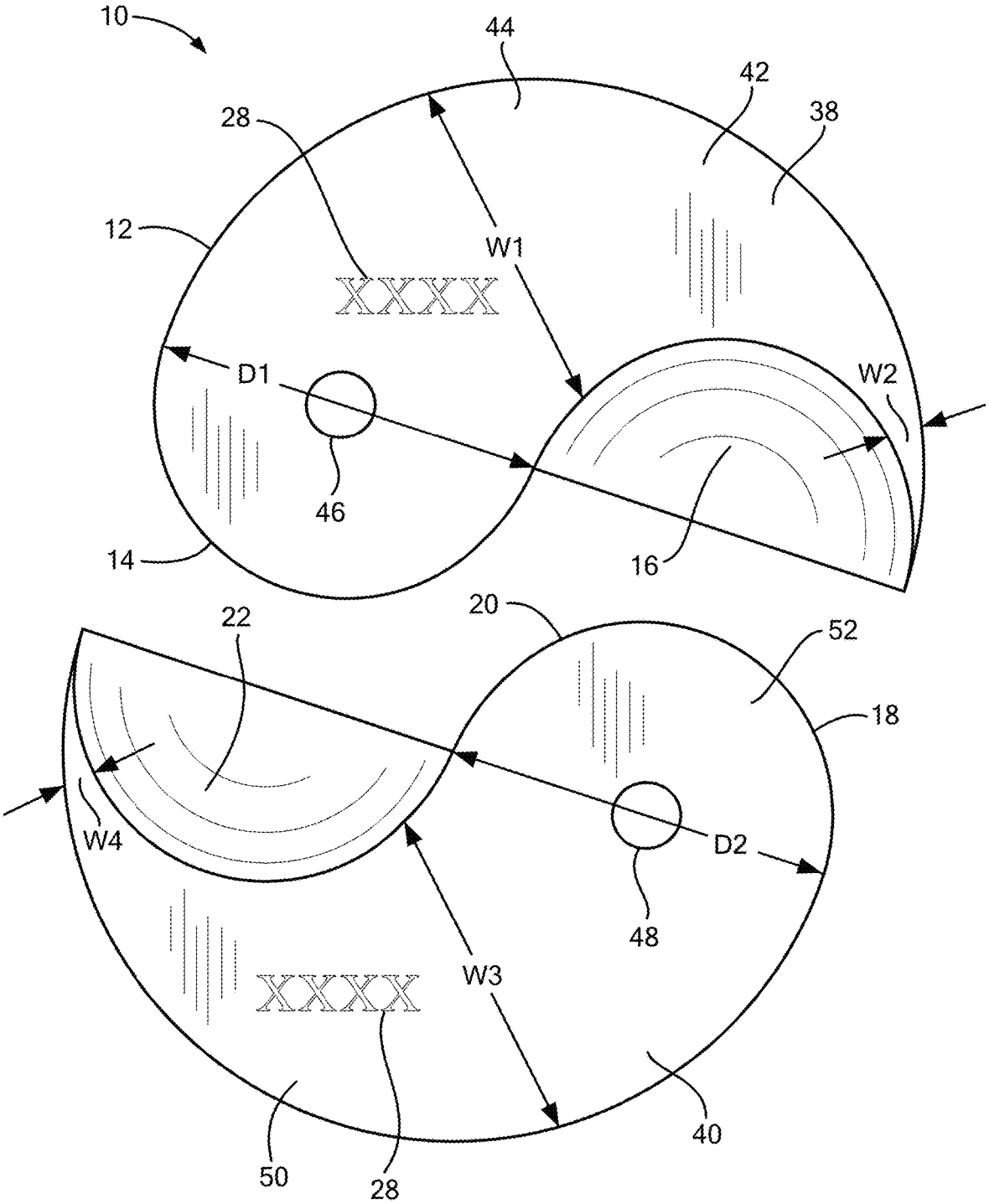
FIG. 1*c* is a bottom view of an exemplary embodiment of the multi-component structure of the present disclosure having complementary segments.

The first complementary segment 12 may be a mirror image of the second complementary segment 18 so that the second concave portion 22 of the second complementary segment 18 is sized and shaped to be received within the first convex portion 14 of the first complementary segment 12 as shown in more detail in FIG. 1*c*. Also, the second convex portion 20 of the second complementary segment 18 is sized and shaped to be received within the first concave portion 16 of the first complementary segment 12 as shown in more detail in FIG. 1*c*. Also, as shown in FIG. 1*a*, the first complementary segment 12 and the second complementary segment 18 are in the shape of a quadra sphere and/or a spherical cape which is a portion of a sphere that is separated by a plane that creates a curved section with a flat base. The second convex portion 20 and the second concave portion 22 may be found on a second inner surface 26 of the first complementary segment 12. The contiguous second convex portion 20 and second concave portion 22 may follow the contour of the second inner surface 26, a second contour, to create a unique shape and design. The size and shape of the first complementary segment 12 and the second complementary segment 18 may vary and the exemplary embodiment is one non-limiting embodiment.

The first complementary segment 12 and the second complementary segment 18 may also include at least one indicia 28 (also referred to as indicia 28) which may include but are not limited to signs, indications, stampings, markings, or other representations. The indicia 28 may be flat on the surface and/or the indicia 28 may be raised and protrude outwardly from the surface. The indicia 28 may also be recessed inwardly into the surface as well. The use of flat, protruding, and recessed indicia 28 can create a unique tactile experience when touching the indicia 28. The indicia 28 may be one color or many different colors. As shown in FIG. 1*a*, the indicia 28 may include a plurality of indicia 28 on the first inner surface 24 and the second inner surface 26 but it will also be understood that the indicia 28 may include one indicia 28 or a plurality of indicia 28.

In one embodiment, indicia 28 on first inner surface 24 may be complementary to other indicia 28 on second inner surface 26 such that they create a specific composite pattern, design, and/or meaning when first complementary segment 12 is joined with second complementary segment 18. The indicia 28 may be created to convey a certain mood, or draw the eye in a certain direction, or evoke a number of feelings. Depending upon the composition of the indicia 28 on the multi-component structure 10, the indicia 28 may be pleasing to the eye and may employ elements of contrast, balance, emphasis, proportion, hierarchy, repetition, rhythm, pattern, white space, movement, variety, unity, and other design elements to create the indicia 28. It will be understood that the indicia 28 on the first complementary segment 12 may be the same as the indicia 28 on any other complementary segment in the multi-component structure 10. Also, the indicia 28 on the first complementary segment 12 may be different from the indicia 28 on any other complementary segment in the multi-component structure 10.

For example, the indicia 28 on the first complementary segment 12 may be complementary to the indicia 28 on the second complementary segment 18 and/or the indicia 28 on the first complementary segment 12 may be complementary to the indicia 28 on any other complementary segment in the multi-component structure 10. By way of another example, the first complementary segment 12 may have indicia 28 of a part of a tree and the second complementary segment 18 may have indicia 28 for another part of the a tree and/or entirely different indicia 28 such that when the first complementary segment 12 is joined with the second complementary segment, the complete tree can be seen. Also, any other complementary segment in the multi-component structure 10 may have indicia 28 for another part of the a tree and/or entirely different indicia 28. Further, the first complementary segment 12 may have only one indicia 28 and any other complementary segment in the multi-component structure 10 may have a plurality of indicia 28. It will also be understood that the indicia 28 on the second complementary segment 18 may be the same as the indicia 28 on any other complementary segment in the multi-component structure 10. Also, the indicia 28 on the second complementary segment 18 may be different from the indicia 28 on any other complementary segment in the multi-component structure 10. For example, the indicia 28 on the second complementary segment 18 may be complementary to the indicia 28 on any other complementary segment in the multi-component structure 10. In this non-limiting example, the second complementary segment 18 may have indicia 28 for a part of a tree and any other complementary segment in the multi-component structure 10 may have indicia for another part of the a tree and/or entirely different indicia 28. Also, the second complementary segment 18 may have only one indicia 28 and any other complementary segment in the multi-component structure 10 may have a plurality of indicia 28. Each of the complementary segments may have any variety of indicia 28 which may be identical, complementary to one another, or any variation of indicia 28. Each complementary segment 12, 18 may have indicia 28 which are customizable as well.

FIG. 1*b* is an exemplary embodiment showing the second view of the first complementary segment 12 and the second complementary segment 18. The first complementary segment 12 may have a first outer surface 30. The first outer surface 30 may include at least one indicia 28 and as a non-limiting example as shown in FIG. 1*b* may include two indicia 28. The first outer surface 30 may be rounded and smooth, but it will be understood that the first outer surface 30 may also include indicia 28 with various protrusions or recessed portions to create different textures and styles on the multi-component structure 10. The first outer surface 30 may be in the shape of a portion of a semicircle and form a first quarter circle 34, but it will be understood that this is one embodiment of the multi-component structure 10 and a variety of different shapes may be used to create the multi-component structure 10. The shapes may be a regular shape or could be an irregular pattern as well to create visual and tactile interest in the multi-component structure 10.

The second complementary segment 18 may have a second outer surface 32. The second outer surface 32 may include at least one indicia 28. The second outer surface 32 may be rounded and smooth, but it will be understood that the second outer surface 32 may also include indicia 28 with various protrusions or recessed portions to create different textures and styles on the multi-component structure 10. The second outer surface 32 may be in the shape of a portion of a semicircle and form a second quarter circle 36, but it will be understood that this is one embodiment of the multi-component structure 10 and a variety of different shapes may be used to create the multi-component structure 10.

Figure 1D:
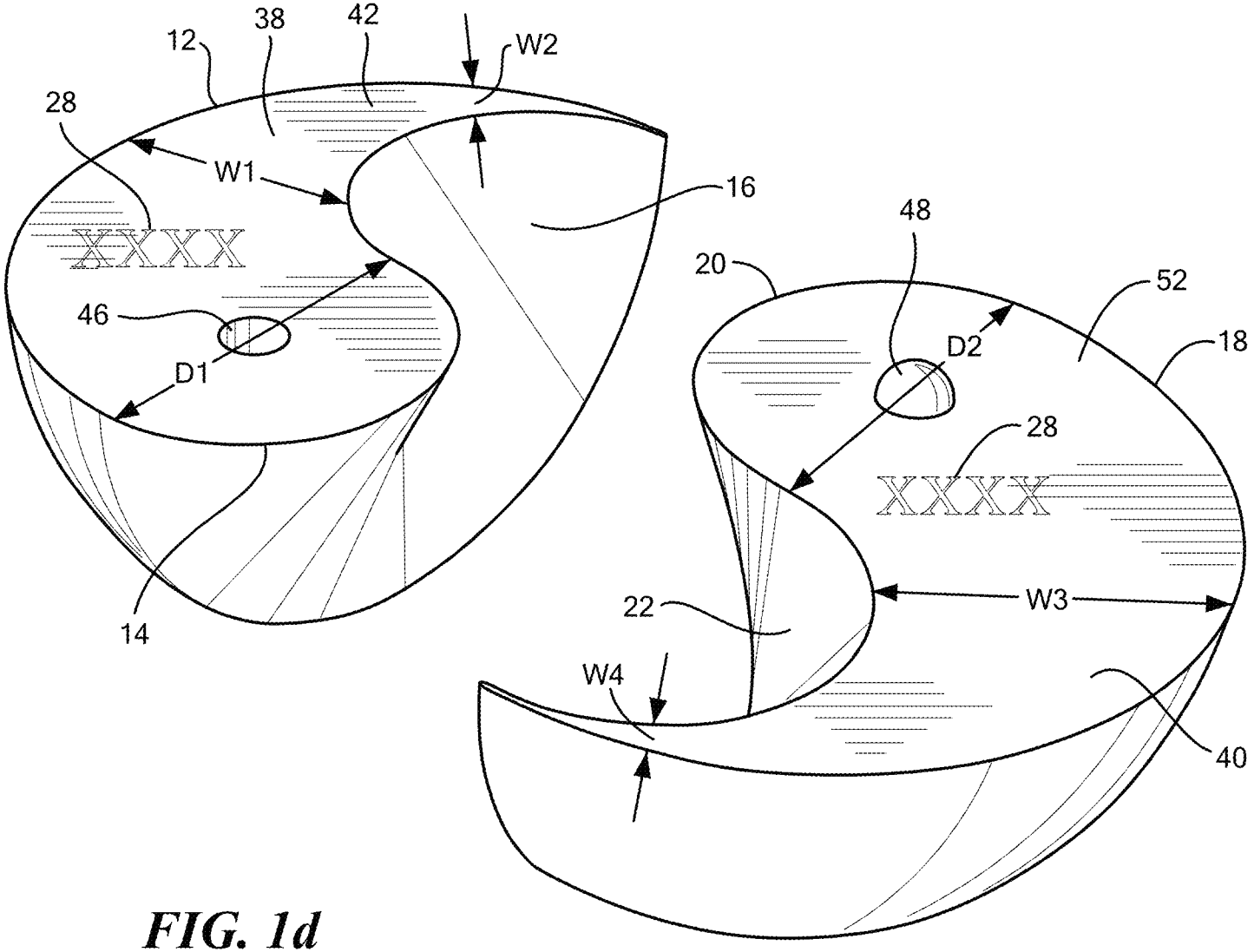
FIG. 1*d* is a perspective bottom view of an exemplary embodiment of the multi-component structure of the present disclosure having complementary segments.

FIG. 1*c* shows a bottom view of the first complementary segment 12 and the second complementary segment 18 and FIG. 1*d* shows a perspective bottom view of the first complementary segment 12 and the second complementary segment 18 showing the bottom surface of these two segments and a perspective view of the bottom surfaces of the first complementary segment 12 and the second complementary segment 18. The first complementary segment 12 has a first bottom surface 38 and the second complementary segment 18 has a second bottom surface 40. The first bottom surface 38 may be flat and on a single plane without any protrusions and/or indentations in the surface. Alternatively, the first bottom surface 38 may have protrusions in certain locations and/or recesses as well. If the first bottom surface 38 has protrusions and/or recesses in certain locations on the surface, there may be another complementary segment, which may be the second complementary segment 18 or another complementary segment, which has a complementary corresponding protrusions and/or recesses such that the first bottom surface 38 can be mated with the complementary segment.

For example, if the first bottom surface 38 has a protrusion in a particular location, the complementary segment which may be couplable with the first bottom surface 38 may have an indentation in a location on the complementary segment such that the indentation is sized and shaped to receive the protrusion from the first bottom surface 38. As another example, if the first bottom surface 38 has an indentation in a particular location, the complementary segment which may be couplable with the first bottom surface 38 may have a protrusion in a location on the other complementary segment such that the protrusion is sized and shaped to receive the indentation from the first bottom surface 38. It will be understood that the second bottom surface 40 may have indentations and/or protrusions which are sized and shaped to be received within corresponding indentations and/or protrusions on other complementary segments of the multi-component structure 10.

The first bottom surface 38 of the first complementary segment 12 may be comprised of various portions. An exemplary embodiment of the first bottom surface 38 may be comprised of a first elongate portion 42 having various sizes and shapes depending upon the overall design of the multi-component structure 10. The first elongate portion 42 is elongated and the width of the elongated portion decreases in size from one end to the other end For example, starting on one end of the first elongate portion 42 there is a first width W1 which larger than the second width W2 in the first elongate portion 42. As shown in FIGS. 1*c* and 1*d*, the width of the first elongate portion 42 starts out with the first width W1 and the width continually decreases until reaching the second width W2 on this particular portion. This is one exemplary embodiment of the first elongate portion 42 and the width of this elongate portion can gradually decrease when moving from one side of the first elongate portion 42 to the other side of the first elongate portion 42. The first elongate portion 42 may also have the same width throughout or the first elongate portion may have different widths as well. The widths, the dimensions, and the general shape of the first elongate portion 42 may correspond to any complementary elongate portions of the multi-component structure 10 such that when the first elongate portion 42 is coupled with a complementary elongate portion of the multi-component structure 10 the two portions are mirror images of one another and can be releasably mated and/or releasably secured together.

The first bottom surface 38 of the first complementary segment 12 may also have a first circular portion 44 and the first circular portion 44 may be a circle such that the circular portion 44 has one diameter D1. The first circular portion 44 may also be in the shape of an oval or another irregular shape where the first circular portion 44 has at least two different diameters. The diameter and/or diameters, the dimensions, and the general shape of the first circular portion 44 may correspond to any complementary circular portions of the multi-component structure 10 such that when the first circular portion 44 is coupled with a complementary elongate portion of the multi-component structure 10 the two portions are a mirror image of one another and can be releasably mated and/or secured together. The first circular portion 44 and the first elongate portion 42 may be joined to one another either permanently or the two portions may be releasably mateable and/or securable with one another.

The first circular portion 44 may have a first securing mechanism 46 and in this exemplary embodiment the first securing mechanism 46 may be disposed in and/or on the first circular portion 44. The size, shape, and dimensions of the first securing mechanism 46 may be variable depending up the multi-component structure 10 any corresponding securing mechanism that is to be used with the first securing mechanism 46. As shown in FIGS. 1*c* and 1*d*, in one non-limiting example, the first securing mechanism 46 may be disposed in the center of the circle in the first circular portion 44. It will be understood that the first securing mechanism 46 may be one securing mechanism or a plurality of securing mechanisms may be used in any of the complementary segments. In one exemplary embodiment of the multi-component structure 10, the first securing mechanism 46 may be a magnet. In the exemplary embodiment where the first securing mechanism 46 is a magnet, it will be understood that the first complementary segment 12 may have the same magnet as any other complementary segment in the multi-component structure 10. Alternatively, the magnet in the first complementary segment 12 may have a different polarity and/or strength than the magnet in any other complementary segment in the multi-component structure 10. Further, it will be understood that the second complementary segment 18 may have the same magnet as any other complementary segment in the multi-component structure 10. Alternatively, the magnet in the second complementary segment 18 may have a different polarity and/or strength than the magnet in any other complementary segment in the multi-component structure 10.

However, the first securing mechanism 46 can be any type of mechanism that may be used to secure at least two segments together. For example, the first securing mechanism 46 and any other securing mechanism used in the multi-component structure 10 may be the magnet, a hook and loop fastener, a recessed portion that is mateable with a hook, slotted pieces that are mateable, screws, a clamp, glue or other adhesives, as well as other means that may be used to couple segments of the multi-component structure 10 to one another. It will also be understood that when any other securing mechanism is used in the multi-component structure 10, the securing mechanisms that are used in the first complementary segment 12 and any other complementary segment in the multi-component structure 10 may be the same, they may be complementary to one another, or they may be different from one another. As shown in FIGS. 1*c* and 1*d*, the first securing mechanism 46 is a magnet and the magnet is recessed within the center of the first circular portion 44 of the first bottom surface 38 such that the first securing mechanism 46 is flush with the first bottom surface 38 and extends inwardly into the first convex portion 14 of the first complementary segment 12.

Although first securing mechanism 46 is shown as being flush with the first bottom surface 38, it will be understood that the first securing mechanism 46 may be recessed anywhere within the first bottom surface 38 and in alternative embodiments the first securing mechanism 46 may extend outwardly from the first bottom surface 38. The location, size, and shape of the first securing mechanism 46 may be dependent upon what other complementary securing mechanism the first securing mechanism 46 is going to be coupled and/or mated with in the multi-component structure 10.

As one non-limiting example, the first securing mechanism 46 may be mated with a second securing mechanism 48 on the second bottom surface 40 that is part of the second complementary segment 18. In the exemplary embodiment where the first securing mechanism 46 is a magnet, it will be understood that the second complementary segment 18 may have the same magnet any other complementary segment in the multi-component structure 10. Alternatively, the magnet in the second complementary segment 18 may have a different polarity and/or strength than the magnet in any other complementary segment in the multi-component structure 10. However, the second securing mechanism 48 can be any type of mechanism that may be used to secure at least two segments together. For example, the second securing mechanism 48 and any other securing mechanism used in the multi-component structure 10 may be the magnet, a hook and loop fastener, a recessed portion that is mateable with a hook, slotted pieces that are mateable, screws, a clamp, glue or other adhesives, as well as other means that may be used to couple segments of the multi-component structure 10 to one another. Like the first bottom surface 38, the second bottom surface 40 may be flat without any protrusions and/or indentations in the surface. Alternatively, the second bottom surface 40 may have protrusions in certain locations and indentations as well. If the second bottom surface 40 has protrusions and/or indentations in certain locations on the surface, there may be another complementary segment, which may be the second complementary segment 18 or another complementary segment, which has a complementary corresponding protrusion and/or indentation. For example, if the first bottom surface 38 has a protrusion in a particular location, the second bottom surface 40 may have an indentation that is in a particular location and is couplable with the protrusion from the first bottom surface 38. As another example, if the first bottom surface 38 has an indentation in a particular location, the second complementary segment 18 may have a second bottom surface 40 which may be coupleable with the first bottom surface 38. The second complementary segment 18 may have a protrusion in a specific location and the first bottom surface 38 may have a corresponding recessed portion that is sized and shaped to receive the protrusion when the first bottom surface 38 is coupled with the second bottom surface 40. It will be understood that the second bottom surface 40 may have indentations and/or protrusions which are sized and shaped to be received within corresponding indentations and/or protrusions on other complementary segments of the multi-component structure 10 as well.

The second bottom surface 40 of the second complementary segment 18 may be comprised of various portions which may be complementary or the mirror image of the first bottom surface 38. An exemplary embodiment of the second bottom surface 40 may be comprised of a second elongate portion 50 and the second elongate portion 50 may be various sizes and shapes depending upon the overall design of the multi-component structure 10. The second elongate portion 50 as shown in FIGS. 1*c* and 1*d* is elongated and the width of the elongated portion decreases in size from one end to the other. For example, starting on one end of the second elongate portion 50 there is a third width W3 which larger than the fourth width W4 in the second elongate portion 50. As shown in FIGS. 1*c* and 1*d*, the width of the second elongate portion 50 starts out with the third width W3 and the width continually decreases until reaching the fourth width W4 on this particular portion. In an exemplary embodiment where the second bottom surface 40 is the mirror image of the first bottom surface 38, the third width W3 may be the same as the first width W1 and the fourth width W4 may be the same as the second width W2. Having this complementary size allows the first bottom surface 38 to be mated with the second bottom surface 40 where each bottom surface is the mirror image of one another. This is one exemplary embodiment of the second elongate portion 50 and the width of this elongate portion can gradually decrease when moving from one side of the second elongate portion 50 to the other side of the second elongate portion 50. The second elongate portion 50 may also have the same width throughout or the second elongate portion 50 may have different widths throughout this portion as well. The widths, the dimensions, and the general shape of the second elongate portion 50 may correspond to any complementary elongate portions of the multi-component structure 10 such that when the second elongate portion 50 is coupled with the first elongate portion 42 and/or another complementary elongate portion of the multi-component structure 10 the two portions are mirror images of one another and can be releasably mated and/or secured together.

The second bottom surface 40 of the first complementary segment 12 may also have a second circular portion 52 and the second circular portion 52 may be a circle such that the second circular portion 52 has one diameter D2. The second circular portion 52 may also be in the shape of an oval or another irregular shape where the second circular portion 52 has at least two different diameters. The diameter and/or diameters, the dimensions, and the general shape of the second circular portion 52 may correspond to any complementary circular portions of the multi-component structure 10 such that when the first circular portion 44 is coupled with the second circular portion 52 and/or another complementary circular portion of the multi-component structure 10 the two portions are mirror images of one another and can be releasably mated and/or secured together. The second circular portion 52 and the second elongate portion 50 may be joined to one another either permanently or the two portions may be releasably mateable and/or securable with one another.

As shown in FIGS. 1*c* and 1*d*, the second circular portion 52 may have the second securing mechanism 48 and the second securing mechanism 48 may be disposed in and/or on the second circular portion 52. The size, shape, and dimensions of the second securing mechanism 48 may be variable depending up the multi-component structure 10 any corresponding securing mechanism that is to be used with the second securing mechanism 48. By way of example, the second securing mechanism 48 may be the same size and shape of the first securing mechanism 46 such that when the first bottom surface 38 is coupled with the second bottom surface 40, the first securing mechanism 46 mates with the second securing mechanism 48 and secures the first complementary segment 12 with the second complementary segment 18. As a non-limiting example, like the first securing mechanism 46, the second securing mechanism 48 may be disposed in the center of the circle in the second circular portion 52. It will be understood that the second securing mechanism 48 may be one securing mechanism or a plurality of securing mechanisms may be used in any of the complementary segments. In one exemplary embodiment of the multi-component structure 10, the first securing mechanism 46 may be a magnet. However, like the first securing mechanism 46, the second securing mechanism 48 can be any type of mechanism that may be used to secure at least two segments together including but not limited to a magnet, a hook and loop fastener, a recessed portion that is mateable with a hook, slotted pieces that are mateable, screws, a clamp, glue or other adhesives, as well as other means that may be used to couple segments of the multi-component structure 10 to one another.

As shown in FIGS. 1*c* and 1*d*, the second securing mechanism 48 is a magnet and the magnet is recessed within the center of the second circular portion 52 of the second bottom surface 40 such that the second securing mechanism 48 us flush with the second bottom surface 40 and extends inwardly into the second convex portion 20 of the second complementary segment 18. The second securing mechanism 48 is shown as being flush with the second bottom surface 40 however it will be understood that the second securing mechanism 48 may be recessed within the second bottom surface 40 and in alternative embodiments the second securing mechanism 48 may extend outwardly from the second bottom surface 40. The location, size, and shape of the second securing mechanism 48 may be dependent upon what other complementary securing mechanism the second securing mechanism 48 is going to be coupled and/or mated with in the multi-component structure 10. As a non-limiting example, the second securing mechanism 48 may be coupled with the first securing mechanism 46 so that the first bottom surface 38 is flush with the second bottom surface 40 and the first complementary segment 12 is mated with the second complementary segment 18.

Figure 2:
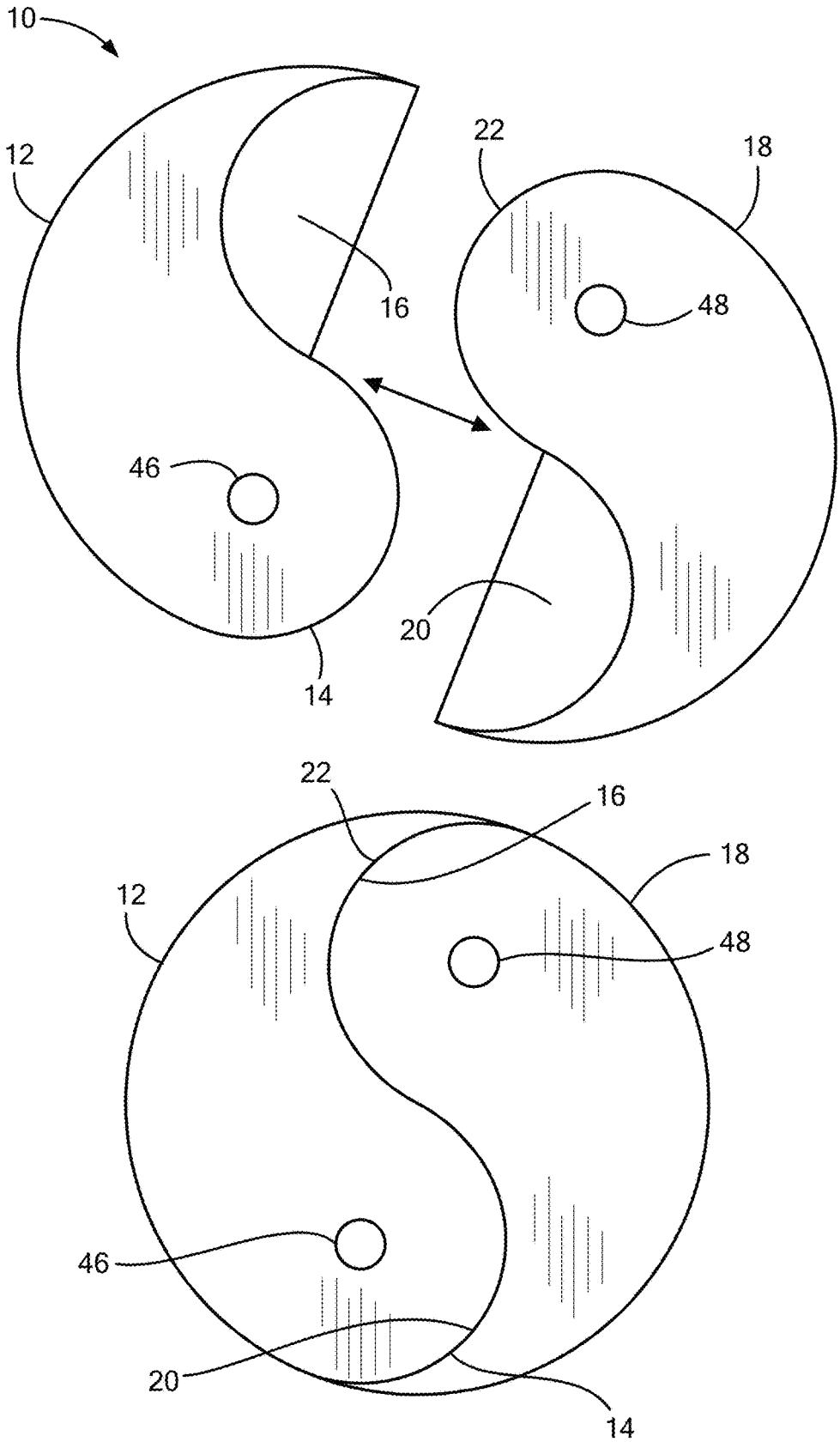
FIG. 2 is an exemplary embodiment of the multi-component structure of the present disclosure showing a first complementary segment and a second complementary segment separated and mated together.

Now referring to FIG. 2 where the first complementary segment 12 is completely separated from the second complementary segment 18. Initially, the first convex portion 14 is directly opposite the second concave portion 20 and the first concave portion 16 is directly opposite the second convex portion 22 so that the first complementary segment 12 can be coupled with the second complementary segment 18. Also as shown in FIG. 2, the first complementary segment 12 is mated with the second complementary segment 18. This mating may be where the first complementary segment 12 is releasably mated and/or secured with the second complementary segment 18 or alternatively the first complementary segment 12 may be permanently secured with the second complementary segment 18. When the first complementary segment 12 is mated with the second complementary segment 18, the first convex portion 14 may be placed within the second concave portion 20 and the second convex portion 22 may be placed within the first concave portion 16. When the first complementary segment 12 is mated with the second complementary segment 18, the second securing mechanism 48 may be disposed proximate to the first securing mechanism 46 but the securing mechanisms 46, 48 may not be in direct physical contact with one another. When the first complementary segment 12 is mated with the second complementary segment 18, in an alternative embodiment, various securing mechanisms may be disposed to be in direct physical contact with one another or in the case of a magnet, the various securing mechanisms may be disposed to be magnetically engaged with one another as well. As a non-limiting example, when the first complementary segment 12 is mated with the second complementary segment 18 this may create a first hemisphere 54.

Figure 3A:
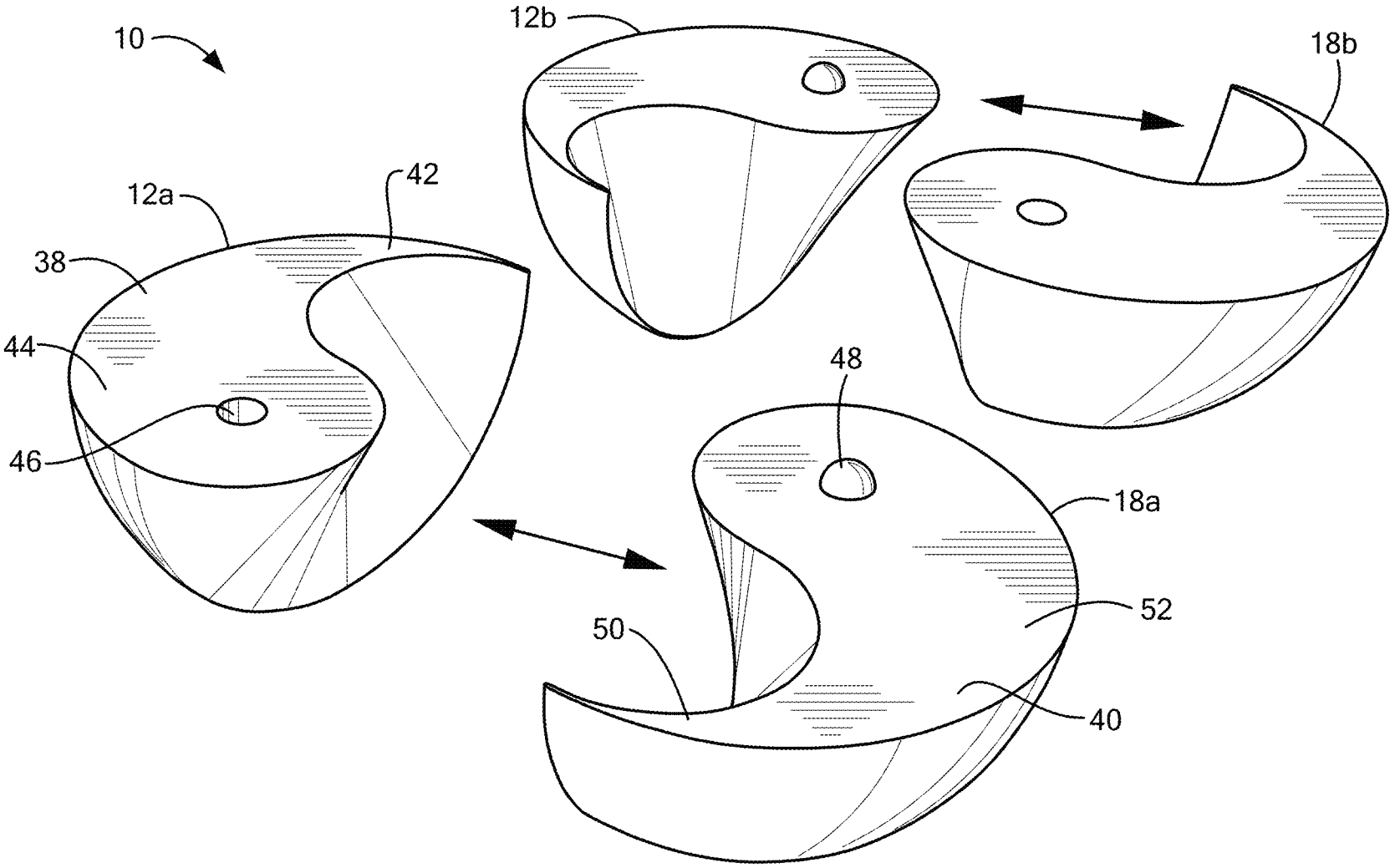
FIG. 3*a* is an exemplary embodiment of the multi-component structure of the present disclosure showing the complementary segments separated.

Now referring to FIG. 3*a*, another embodiment of the multi-component structure 10 is shown where there are four separate complementary segments 12*a*, 12*b*, 18*a*, 18*b* that are separated and can also be engaged with one another. When referring to first complementary segment 12 in this disclosure, it will be understood that this includes the first complementary segment 12*a* and a third complementary segment 12*b* where the third complementary segment 12*b* may share the same the features, parts, and/or components described for the first complementary segment 12*a*. To the extent that there may be differences in the features, parts, and/or components between the first complementary segment 12*a* and the third complementary segment 12*b*, these features, parts, and/or components will be addressed separately in this application through the discussion of the first complementary segment 12*a* and the third complementary segment 12*b*. When referring to second complementary segment 18 in this application, it will be understood that this includes the second complementary segment 18*a* and a fourth complementary segment 18*b* where the fourth complementary segment 18*b* may share the same features, parts, and/or components described for the second complementary segment 18*a*. To the extent that there may be differences in the features, parts, and/or components between the second complementary segment 18*a* and the fourth complementary segment 18*b*, these features, parts, and/or components will be addressed separately in this application through the discussion of the second complementary segment 18*a* and the fourth complementary segment 18*b*.

The exemplary multi-component structure 10 includes the first complementary segment 12*a* and the second complementary segment 18*a* as described herein as well as the third complementary segment 12*b* and the fourth complementary segment 18*b*. The third complementary segment 12*b* may be a mirror image of the first complementary segment 12*a* and the fourth complementary segment 18*b* may be mirror image of the second complementary segment 18*a*. As discussed herein, the securing mechanism 46*a* in the first complementary segment 12*a* and the securing mechanism 46*b* in the third complementary segment 12*b* may be identical or the securing mechanisms 46*a*, 46*b* may be different from one another. For example, if the securing mechanisms 46*a*, 46*b* are magnets, securing mechanism 46*a* may have a different polarity and/or strength from securing mechanism 46*b*. Also, as discussed herein, the securing mechanism 48*a* in the second complementary segment 18*a* and the securing mechanism 48*b* in the fourth complementary segment 18*b* may be identical or the securing mechanisms 48*a*, 48*b* may be different from one another. For example, if the securing mechanisms 48*a*, 48*b* are magnets, securing mechanism 48*a* may have a different polarity and/or strength from securing mechanism 48*b*.

Figure 3B:
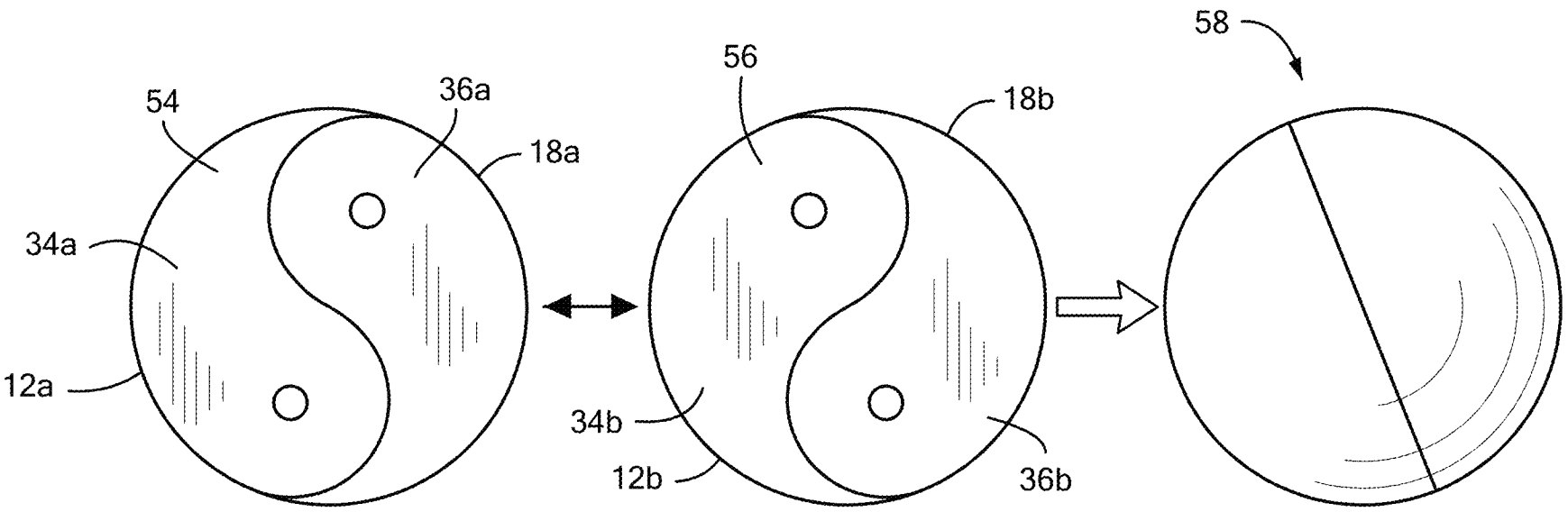
FIG. 3*b* is an exemplary embodiment of the multi-component structure of the present disclosing showing the complementary segments mated together.

Now referring to FIG. 3*b*, the first complementary segment 12*a* and the second complementary segment 18*a* may be releasably or permanently secured together to form the first hemisphere 54. Further, the third complementary segment 12*b* and the fourth complementary segment 18*b* may be releasably or permanently secured together to form a second hemisphere 56. The third outer surface 30*b* may be in the shape of a portion of a semicircle and form a third quarter circle 34*b*, but it will be understood that this is one embodiment of the multi-component structure 10 and a variety of different shapes may be used to create the multi-component structure 10 (not shown in FIG. 3). The fourth outer surface 32*b* may be in the shape of a portion of a semicircle and form a fourth quarter circle 36*b*, but it will be understood that this is one embodiment of the multi-component structure 10 and a variety of different shapes may be used to create the multi-component structure 10. Also, the first hemisphere 54 may be permanently and/or releasably coupled with the second hemisphere 56 to create a sphere 58. In exemplary embodiments, where the securing mechanisms 46, 48 are magnets, the securing mechanisms 46*a*, 48*a* in the first hemisphere 54 may have the same and/or different polarity and/or strength. Further, the securing mechanisms 46*b*, 48*b* in the second hemisphere 56 may have the same and/or different polarity and/or strength. Having magnets with different strengths and/or polarities can allow the various complementary segments 12*a*, 12*b*, 18*a*, 18*b* to be secured together with stronger and/or weaker magnetic fields and the relative strength and/or weakness of the magnetic field may be based, in part, on how the multi-component structure 10 is being used. For example, if the multi-component structure 10 is a puzzle, it may be helpful to have a weaker magnetic field so that a user can assemble and disassemble the complementary segments 12*a*, 12*b*, 18*a*, and 18*b*. As another example, if the multi-component structure 10 is being integrated into a sculpture and/or furniture, it may be helpful to have a stronger magnetic field so that is it more difficult to separate the complementary segments 12*a*, 12*b*, 18*a*, and 18*b*.

Figure 4A:
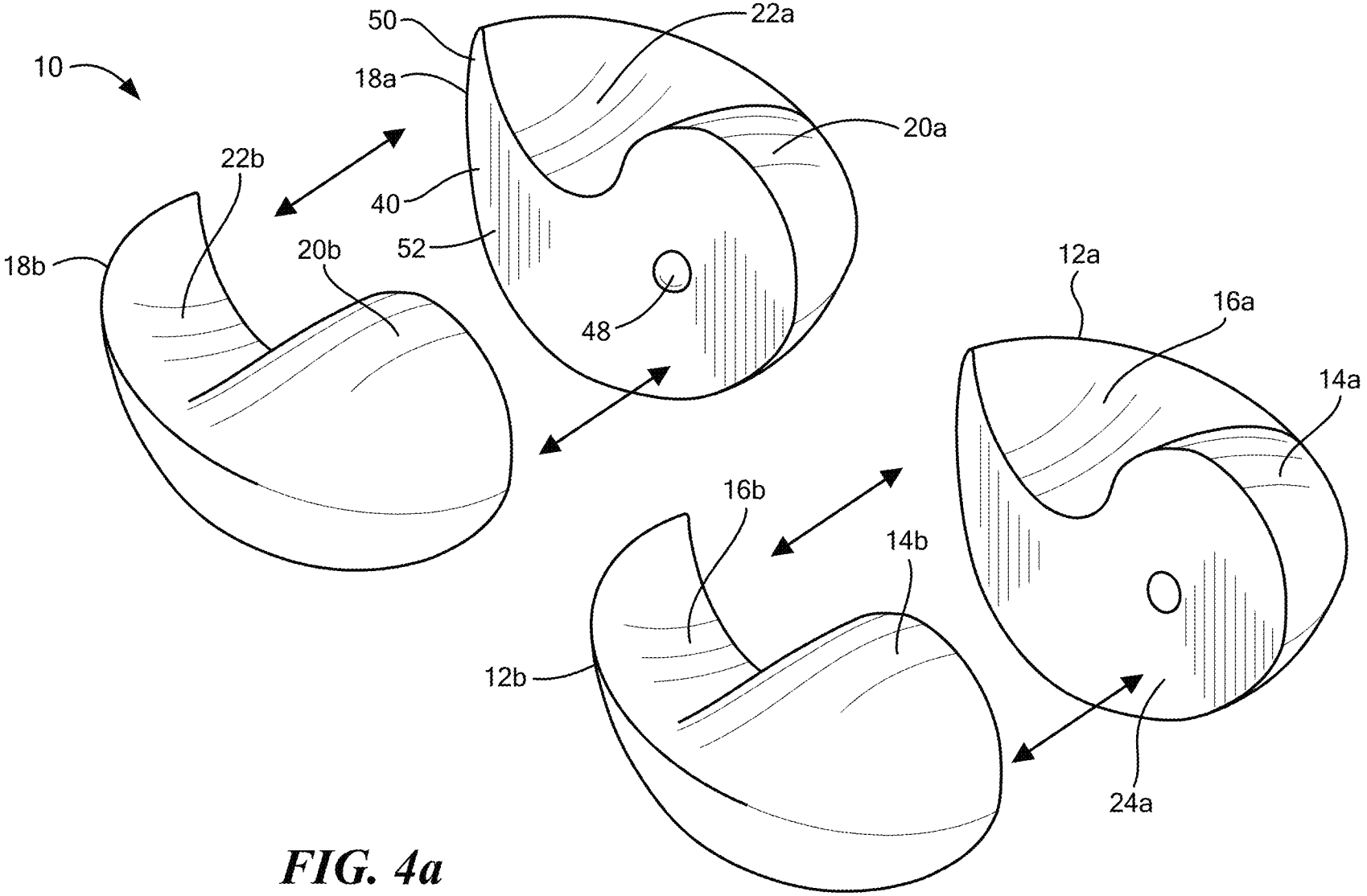
FIG. 4*a* is an alternative embodiment of the multi-component structure of the present disclosure showing the complementary segments separated.

Now referring to FIG. 4*a* is another embodiment of the multi-component structure 10 where the four separate complementary segments 12*a*, 12*b*, 18*a*, 18*b* are separated in a different manner than as shown in FIGS. 3*a* and 3*b* and can also be engaged with one another to form a sphere 58 in a different manner than as shown in FIGS. 3*a* and 3*b*. In this embodiment, the first complementary segment 12*a* and the third complementary segment 12*b* are separable from one another and the second complementary segment 18*a* and the fourth complementary segment 18*b* are separable from one another. The second complementary segment 18*a* and the fourth complementary segment 18*b* may be separated from one another. Although not shown in FIG. 4*a*, the second complementary segment 18*a* and the fourth complementary segment 18*b* may be mated together such that the second inner surface 26*a* of the second complementary segment 18*a* and the second inner surface 26*b* of the fourth complementary segment 18*b* may be mated with one another. If the second inner surface 26*a* of the second complementary segment 18*a* and the second inner surface 26*b* of the fourth complementary segment 18*b* are mated together, than the second convex portion 20*a* from the second complementary segment 18*a* and the second convex portion 20*b* from the fourth complementary segment 18*b* will be proximate one another. Further, if the second inner surface 26*a* of the second complementary segment 18*a* and the second inner surface 26*b* of the fourth complementary segment 18*b* are mated together, than the second concave portion 22*a* from the second complementary segment 18*a* and the second concave portion 22*b* from the fourth complementary segment 18*b* will be proximate one another. Further, the first complementary segment 12*a* and the third complementary segment 12*b* may be separated from one another and mated together such that the first inner surface 24*a* of the first complementary segment 12*a* and the first inner surface 24*b* of the third complementary segment 12*b* may be mated with one another. If the first inner surface 24*a* of the first complementary segment 12*a* and the first inner surface 24*b* of the third complementary segment 12*b* are mated together than the first convex portion 14*a* from the first complementary segment 12*a* and the first convex portion 14*b* from the third complementary segment 12*b* will be proximate one another. Further, if the first inner surface 24*a* of the first complementary segment 12*a* and the first inner surface 24*b* of the third complementary segment 12*b* are mated together than the first concave portion 16*a* from the first complementary segment 12*a* and the first concave portion 16*b* from the third complementary segment 12*b* will be proximate one another.

Figure 4B:
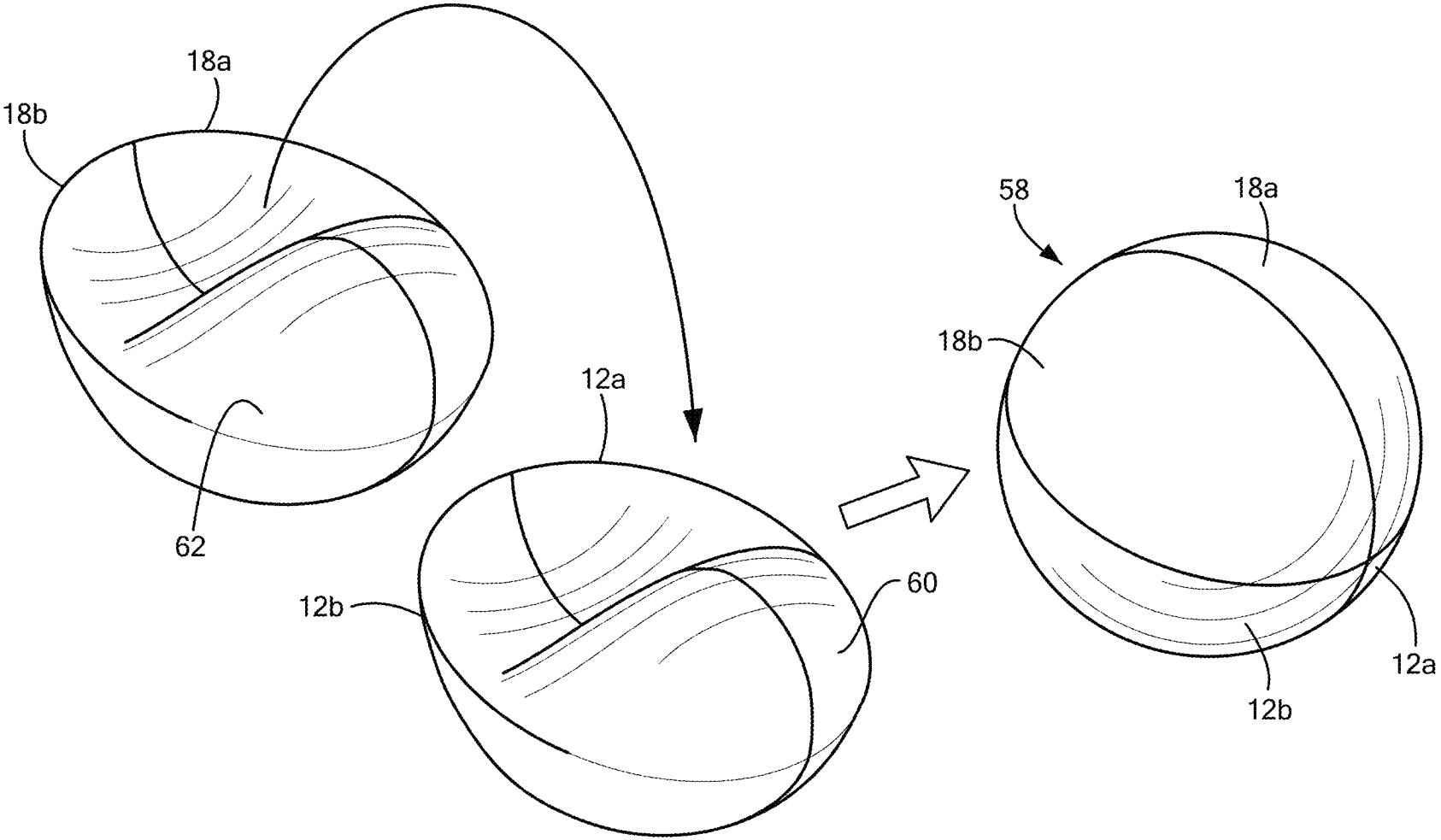
FIG. 4*b* is an alternative embodiment of the multi-component structure of the present disclosing showing the complementary segments mated together.

Now referring to FIG. 4*b*, the first complementary segment 12*a* and the third complementary segment 12*b* may be releasably or permanently secured and/or mated together to form a first part of the sphere 60. Further, the second complementary segment 18*a* and the fourth complementary segment 18*b* may be releasably or permanently secured together to form a second part of the sphere 62. The first part of the sphere 60 and the second part of the sphere 62 may have a different shape from the first hemisphere 54 and the second hemisphere 56. The first convex portion 14*a* of the first complementary segment 12*a* and the first convex portion 14*b* of the third complementary segment 12 have been mated together and the first convex portion 14*a* of the first complementary segment 12*a* and the first convex portion 14*b* of the third complementary segment 12*b* have been mated together to form a different shape than the first hemisphere 54. Further, the second convex portion 20*a* of the second complementary segment 18*a* and the first convex portion 20*b* of the fourth complementary segment 18*b* have been mated together and the second convex portion 20*a* of the second complementary segment 18*a* and the second convex portion 20*b* of the fourth complementary segment 18*b* have been mated together to form a different shape than the second hemisphere 56. It will be understood that these are non-limiting examples of how various segments may be mated together with one another to form different shapes.

The first portion of the sphere 60 may be permanently and/or releasably coupled with the second portion of the sphere 62 to create a sphere 58. The sphere 58 as shown in FIG. 4*b* may be the same shape as the sphere 58 as shown in FIG. 3*b* or it may be a different shape. In exemplary embodiments, where the securing mechanisms 46, 48 are magnets, the securing mechanisms 46*a*, 46*b* in the first portion of the sphere 60 may have the same and/or different polarity and/or strength. Further, the securing mechanisms 48*a*, 48*b* in the second portion of the sphere 62 may have the same and/or different polarity and/or strength. Having magnets with different strengths and/or polarities can allow the various complementary segments 12*a*, 12*b*, 18*a*, 18*b* to be secured together with stronger and/or weaker magnetic fields and the relative strength and/or weakness of the magnetic field may be based, in part, on how the multi-component structure 10 is being used. As another example, if the multi-component structure 10 is being integrated into a sculpture and/or furniture, it may be helpful to have a stronger magnetic field so that is it more difficult to separate the complementary segments 12*a*, 12*b*, 18*a*, and 18*b*.

Figure 5:
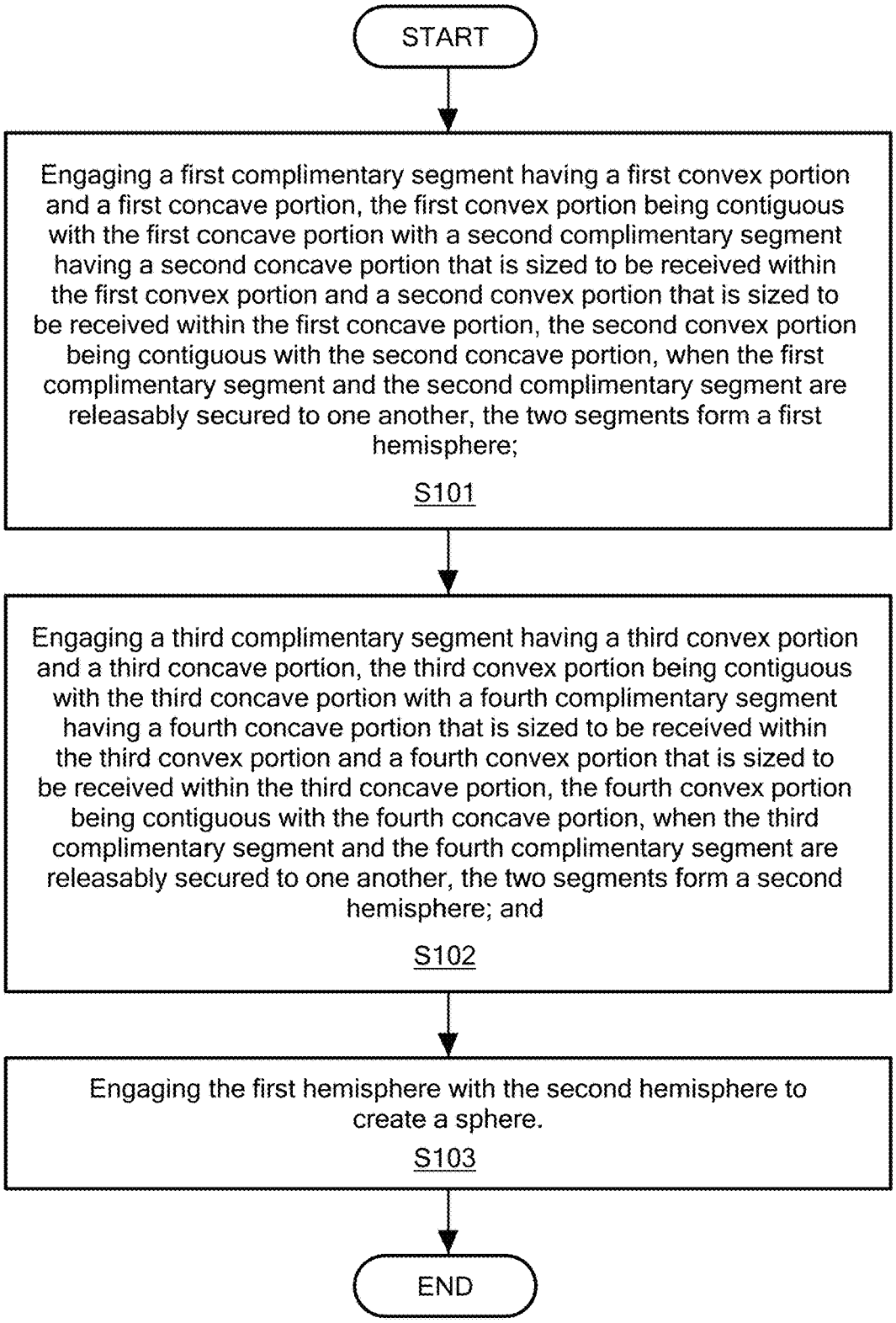
FIG. 5 is an exemplary method of forming the multi-component structure of the present disclosure.

Now referring to FIG. 5, is an exemplary method for forming a sphere 58. The method may comprise engaging a first complementary segment 12*a* having a first convex portion 14*a* and a first concave portion 16*a*, the first convex portion 14*a* being contiguous with the first concave portion 16*a* with a second complementary segment 18*a* having a second concave portion 22*a* that is sized to be received within the first convex portion 14*a* and a second convex portion 20*a* that is sized to be received within the first concave portion 16*a*, the second convex portion 20*a* being contiguous with the second concave portion 22*a*, when the first complementary segment 12*a* and the second complementary segment 18*a* are releasably secured to one another the two segments form a first hemisphere 54. S101. The method may also include engaging a third complementary segment 12*b* having a third convex portion 14*b* and a third concave portion 16*b*, the third convex portion 14*b* being contiguous with the third concave portion 16*b* with a fourth complementary segment 18*b* having a fourth concave portion 22*b* that is sized to be received within the third convex portion 14*b* and a fourth convex portion 20*b* that is sized to be received within the third concave portion 16*b*, the fourth convex portion 20*b* being contiguous with the fourth concave portion 22*b*, when the third complementary segment 12*b* and the fourth complementary segment 18*b* are releasably secured to one another the two segments form a second hemisphere 56. S102. The method may further comprise engaging the first hemisphere 54 with the second hemisphere 56 to create a sphere 58. S103.

The multi-component structure 10 may be in a variety of different shapes. While the exemplary embodiments show spheres and circles, it is understood that the shape of the multi-component structure 10 is not limited to these shapes and may include, but is not limited to an oval, a triangle, a rectangle, a heart, an octagon, a hexagon, a pentagon, a trapezoid, a rhombus, a square, a parallelogram, a star, a semicircle, a decagon, a crescent and a cross. The multi-component structure 10 may be made for a variety of different materials. Each of the complementary segments in the multi-component structure 10 may be made from the same material and/or each of the complementary segments in the multi-component structure 10 may be made from different material. Additionally, each individual complementary segment may be made from a single material or each individual complementary segment may be made from more than one material This material may include, but is not limited to wood, plastic, metal, cardboard, cork, magnets, leather, nylon, adhesives, rubber, and other synthetic and/or organic materials. The exemplary multi-component structure 10 as shown includes two and four separate complementary segments. However, it will be understood that that the exemplary multi-component structure 10 shown is a non-limiting example and the multi-component structure 10 may be made from at least two complementary segments including as many or as few complementary segments as desired. Further, the multi-component structure 10 as shown maybe of material without any indicia or contains at least one indicia 28, but it will be understood that the multi-component structure 10 may contain one indicia 28 or any pattern or number of indicia 28. The indicia 28 may be standalone indicia 28 on any complementary segment and any indicia 28 may change when any complementary segment is mated with another complementary segment to create an new indicia which is a combination of indicia 28 from the combining of at least two complementary segments.

The multi-component structure 10 may be used and manipulated in the hands of an individual but the multi-component structure 10 may also be integrated into various designs to create a different applications. For example, the geometry of the multi-component structure 10 may be used as small as a handheld apparatus, a light fixture or as a part of a light fixture, a base form (canvas) for painted artworks, a piece of furniture or as large as the massing of a building. Also, the multi-component structure 10 may be used as a sculpture and/or the multi-component structure 10 may be combined with a sculpture to create a singular or multiple pieces of artwork.

Many different embodiments of the multi-component structure 10 have been disclosed herein, in connection with the above description and the drawings. It will be understood that it would be unduly repetitious and obfuscating to literally describe and illustrate every combination and subcombination of these embodiments of the multi-component structure 10. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

It will be appreciated by persons skilled in the art that the present disclosure is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the disclosure, which is limited only by the following claims.

What is claimed is:

1. A multi-component structure comprising complementary segments, the multi-component structure comprising:

a first complementary segment having a first convex portion and a first concave portion, the first convex portion being contiguous with the first concave portion;

a second complementary segment having a second concave portion and a second convex portion, the second concave portion being contiguous with the second convex portion, the second concave portion sized to be received within the first convex portion and the second convex portion sized to be received within the first concave portion, the first complementary segment and the second complementary segment being releasably securable to one another to form a first hemisphere; and at least one magnet that releasably secures the first complementary segment to the second complementary segment.

2. The multi-component structure of claim 1, wherein the first complementary segment has a first bottom surface, the first bottom surface having a first circular portion joined to a first elongate portion, and the second complementary segment has a second bottom surface, the second bottom surface having a second circular portion joined to a second elongate portion.

3. The multi-component structure of claim 2, wherein the multi-component structure further comprises:

a first indicia on the first bottom surface and a second indicia on the second bottom surface, the first and the second indicia being complementary to one another.

4. The multi-component structure of claim 1, wherein the at least one magnet is a first magnet and a second magnet, the first magnet being disposed within the first complementary segment and the second magnet being disposed within the second complementary segment.

5. The multi-component structure of claim 1, wherein the multi-component structure further comprises:

a third complementary segment having a third convex portion and a third concave portion, the third convex portion being contiguous with the third concave portion; and a fourth complementary segment having a fourth convex portion and a fourth concave portion, the fourth convex portion being contiguous with the fourth concave portion, the fourth concave portion sized to be received within the third convex portion and the fourth convex portion sized to be received within the third concave portion, the third complementary segment and the fourth complementary segment being releasably securable to form a second hemisphere, the first hemisphere being releasably securable to the second hemisphere to form a sphere.

6. The multi-component structure of claim 5, wherein the third complementary segment has a third bottom surface, the third bottom surface having a third circular portion that is joined to a third elongate portion, and the fourth complementary segment has a fourth bottom surface, the fourth bottom surface having a fourth circular portion joined to a fourth elongate portion.

7. The multi-component structure of claim 5, wherein the multi-component structure further comprises:

the first complementary segment having a first inner surface with a first contour, the first inner surface having the first convex portion and the first concave portion where the first convex portion and the first concave portion are proximate the first contour and follow the first contour of the first inner surface, and a first outer surface that forms a first quarter circle; and the second complementary segment having a second inner surface with a second contour, the second inner surface having the second convex portion and the second concave portion where the second convex portion and the second concave portion are proximate the second contour and follow the second contour of the second inner surface, and a second outer surface that forms a second quarter circle.

8. The multi-component structure of claim 7, wherein the multi-component structure further comprises:

the third complementary segment having a third inner surface with a third contour, the third inner surface having the third convex portion and the third concave portion where the third convex portion and the third concave portion are proximate the third contour and follow the third contour of the third inner surface, and a third outer surface that forms a third quarter circle; and the fourth complementary segment having a fourth inner surface with a fourth contour, the fourth inner surface having the fourth convex portion and the fourth concave portion where the fourth convex portion and the fourth concave portion are proximate the fourth contour and follow the fourth contour of the fourth inner surface, and a fourth outer surface that forms a fourth quarter circle.

9. The multi-component structure of claim 5, wherein the multi-component structure further comprises at least one securing mechanism that releasably secures the first complementary segment to the second complementary segment and releasably secures the third complementary segment to the fourth complementary segment, such that the first hemisphere can be releasably engaged with the second hemisphere to create a sphere.

10. The multi-component structure of claim 9, wherein the at least one securing mechanism is at least one magnet.

11. A multi-component structure comprising complementary segments, the multi-component structure comprising:

a first complementary segment having a first convex portion, a first concave portion, a first inner surface, a first contour, and a first bottom surface, the first convex portion being contiguous with the first concave portion, the first inner surface having the first convex portion and the first concave portion where the first convex portion and the first concave portion are proximate the first contour and follow the first contour of the first inner surface, a first outer surface that forms a first quarter circle, and the first bottom surface has a first circular portion joined to a first elongate portion;

a second complementary segment having a second concave portion, a second convex portion, a second inner surface, a second contour, and a second bottom surface, the second concave portion being contiguous with the second convex portion, the second concave portion sized to be received within the first convex portion and the second convex portion sized to be received within the first concave portion, the second inner surface having the second convex portion and the second concave portion where the second convex portion and the second concave portion are proximate the second contour and follow the second contour of the second inner surface, a second outer surface that forms a second quarter circle, and the second bottom surface has a second circular portion joined to a second elongate portion;

a third complementary segment having a third convex portion, a third concave portion, a third inner surface with a third contour, and a third bottom surface, the third convex portion being contiguous with the third concave portion, the third inner surface having the third convex portion and the third concave portion where the third convex portion and the third concave portion are proximate the third contour and follow the third contour of the third inner surface, a third outer surface that forms a third quarter circle, and the third bottom surface has a third circular portion joined to a third elongate portion;

a fourth complementary segment having a fourth convex portion; a fourth concave portion, a fourth inner surface with a fourth contour, and a fourth bottom surface, the fourth concave portion being contiguous with the fourth convex portion, the fourth inner surface having the fourth convex portion and the fourth concave portion where the fourth convex portion and the fourth concave portion are proximate the fourth contour and follow the fourth contour of the fourth inner surface, a fourth outer surface that forms a fourth quarter circle, and the fourth bottom surface has a fourth circular portion joined to a fourth elongate portion, the second concave portion sized to be received within the third convex portion and, the fourth concave portion sized to be received within the third convex portion, the first complementary segment being releasably securable to the second complementary segment to form a first hemisphere and the third complementary segment being releasably securable to the fourth complementary segment to form a second hemisphere, the first hemisphere and the second hemisphere being releasably securable to form a sphere;

a first magnet disposed within the first circular portion of the first bottom surface so that the first magnet is flush with the first bottom surface of the first circular portion;

a second magnet disposed within the second circular portion of the second bottom surface so that the second magnet is flush with the second bottom surface of the second circular portion, the first magnet being releasably engageable with the second magnet when the first complementary segment is secured with the second complementary segment;

a third magnet disposed within the third circular portion of the third bottom surface so that the third magnet is flush with the third bottom surface of the third circular portion; and a fourth magnet disposed within the fourth circular portion so that the fourth magnet is flush with the fourth bottom surface of the fourth circular portion, the third magnet being releasably engageable with the fourth magnet when the third complementary segment is secured with the fourth complementary segment, the first hemisphere and the second hemisphere being releasably securable to form a sphere.

12. The multi-component structure of claim 11, wherein:

the first magnet having a first portion and a second portion, the first magnet disposed within the first circular portion so that the first portion of the first magnet protrudes from the first bottom surface of the first circular portion;

the second magnet having a first portion and a second portion, the second magnet disposed within the second circular portion so that the first portion of the second magnet protrudes from the second bottom surface of the second circular portion;

the third magnet having a first portion and a second portion, the third magnet disposed within the third circular portion so that the first portion of the third magnet protrudes from the third bottom surface of the third circular portion; and the fourth magnet having a first portion and a second portion, the fourth magnet disposed within the fourth circular portion so that the first portion of the fourth magnet protrudes from the fourth bottom surface of the fourth circular portion.

13. The multi-component structure of claim 11, wherein:

the first magnet having a first portion and a second portion, the first magnet disposed within the first circular portion so that the first portion of the first magnet is recessed within the first bottom surface of the first circular portion;

the second magnet having a first portion and a second portion, the second magnet disposed within the second circular portion so that the first portion of the second magnet is recessed within the second bottom surface of the second circular portion;

the third magnet having a first portion and a second portion, the third magnet disposed within the third circular portion so that the first portion of the third magnet is recessed within the third bottom surface of the third circular portion; and the fourth magnet having a first portion and a second portion, the fourth magnet disposed within the fourth circular portion so that the first portion of the fourth magnet is recessed within the fourth bottom surface of the fourth circular portion.

14. A method for forming a sphere, the method comprising:

engaging a first complementary segment having a first convex portion, a first concave portion, and a first magnet that is flush with at least a portion of a surface of the first complementary segment, the first convex portion being contiguous with the first concave portion, with a second complementary segment having a second concave portion, a second convex portion, and a second magnet that is flush with at least a portion of a surface of the second complementary segment, the second concave portion being contiguous with the second convex portion, the second concave portion sized to be received within the first convex portion and the second convex portion sized to be received within the first concave portion, when the first complementary segment and the second complementary segment are releasably secured to one another with the first magnet and the second magnet the two segments form a first hemisphere;

engaging a third complementary segment having a third convex portion, a third concave portion, and a third magnet that is flush with at least a portion of a surface of the third complementary segment, the third convex portion being contiguous with the third concave portion with a fourth complementary segment having a fourth concave portion, a fourth convex portion, and a fourth magnet that is flush with at least a portion of a surface of the fourth complementary segment, the fourth concave portion being contiguous with the fourth convex portion, the fourth concave portion sized to be received within the third convex portion and the fourth convex portion that is sized to be received within the third concave portion, when the third complementary segment and the fourth complementary segment are releasably secured to one another with the third magnet and the fourth magnet the two segments form a second hemisphere; and engaging the first hemisphere with the second hemisphere to create a sphere.

* * * * *